US006135843A

United States Patent [19]

Merk et al.

[11] Patent Number: 6,135,843

[45] Date of Patent: Oct. 24, 2000

[54] NOVELTY DEVICE WITH FLOWABLE PARTICULATE

[75] Inventors: Michael Merk, Bay Village; John R. Nottingham, Hunting Valley; John W. Spirk, Jr., Gates Mills; Dennis Futo, Strongsville; Paul Brokaw, Euclid, all of Ohio

[73] Assignee: Thoughtworks, Bay Village, Ohio

[21] Appl. No.: 09/288,945

[22] Filed: Apr. 9, 1999

Related U.S. Application Data

[60] Provisional application No. 60/081,619, Apr. 13, 1998.

[51] Int. Cl.[7] ..... A63H 33/32

[52] U.S. Cl. ..... 446/70; 446/166; 40/409; 40/410

[58] Field of Search ..... 446/70, 166, 167, 446/168, 267, 321, 491; 40/409, 410, 427; 428/13, 137, 138, 913.3; 273/257, 115

[56] References Cited

U.S. PATENT DOCUMENTS

| | | | |
|---|---|---|---|
| 1,221,494 | 4/1917 | Wiley | 40/409 |
| 5,255,460 | 10/1993 | Lee | 40/409 |
| 5,971,762 | 10/1999 | McKenna et al. | 40/406 |

*Primary Examiner*—Kien T. Nguyen
*Assistant Examiner*—Urszula M. Cegielnik
*Attorney, Agent, or Firm*—Fay, Sharpe, Fagan, Minnich & McKee, LLP

[57] ABSTRACT

A novelty device comprised of a transparent body defined by a chamber. First and second horizonal partitions having a plurality of openings depicting text or design traversing said chamber. The first and second partitions in a generally spaced parallel relationship dividing the chamber into a top area, a central area between the partitions and a bottom area. A particulate film material disposed within the chamber.

19 Claims, 4 Drawing Sheets

NOVELTY DEVICE WITH FLOWABLE PARTICULATE

This application claims benefit of provisional application Ser. No. 60/081,619 filed Apr. 13, 1998.

BACKGROUND OF THE INVENTION

This invention relates to a novelty device. More particularly, this invention relates to a novelty device having a generally transparent housing containing a flowable particulate material. The housing is divided into compartments via partitions, the partitions including passageways through which the particulate material flows, resulting in the formation of an image on the partition as the device is rotated. This device can be generally classified as a sand sifter apparatus, although the particulate material is not limited solely to sand.

A variety of hand held novelty items exist which are popular to commemorate events, vacations, famous natural or manmade sights, corporate identities, sporting teams, etc. In fact, it is believed that sand sifter type devices have been utilized for certain of these applications. However, the prior apparatus have typically lacked sophistication and have failed to provide a dramatic visual image. Accordingly, the present invention is directed to providing a superior device.

SUMMARY OF THE INVENTION

Accordingly, it is a primary object of this invention to provide a new and improved novelty device.

Additional objects and advantages of the invention will be set forth in part in the description which follows and in part will be obvious from the description or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the novelty device of this invention comprises a substantially transparent body defining a chamber. First and second partitions, each including a plurality of passages positioned to depict text or an image, are spaced from one another and divide the chamber into three distinct compartments. At least the top and bottom compartments are transparent to provide a line of sight to the surface of each partition. A particulate fill material is contained within the chamber. The particulate material may be sand or beads comprised of glass or other ceramic. The particulate material can also be colored to achieve desired visual effects.

In a particularly preferred form of the invention, the particulate material will be glass beads comprised of at least 70% generally round shapes. Preferably, the particulate material will have a particle size of less than about 1000 microns (about 20 mesh) nominal diameter and the passages in the partitions will have a diameter or a line weight, as appropriate, of less than about 0.10 inches. More preferably, the nominal particle diameter will be between 30 and 1000 microns and more preferably between 50 and 125 microns. Generally, the particulate material size and the line or hole size of the partitions will correspond to achieve a substantially completed flow through of the material in between 5 and 30 seconds.

In a further preferred embodiment of the invention, the first partition will include text image and the second partition will include a design image. Preferably, the design image and text will correspond to each other conceptionally. In a particularly preferred embodiment of the invention, the passage diameters or line weight will vary to tailor the manner in which that the text or image is revealed, e.g. the text will appear form left to right in a particular pattern.

BRIEF DESCRIPTION OF THE DRAWINGS

The invention consists in the novel parts, construction, arrangements, combinations and improvements shown and described. The accompanying drawings, which are incorporated in and constitute a part of this specification, illustrate one embodiment of the invention and together with the description, serve to explain the principles of the invention. Of the Drawings.

DETAILED DESCRIPTION OF THE INVENTION

While the invention will be described in connection with several preferred embodiments, it will be understood that it is not intended to limit the invention to those embodiments. On the contrary, it is intended to cover all alternatives, modifications and equivalents as may be included within the spirit and scope of the invention defined by the appended claims.

Figure 1:
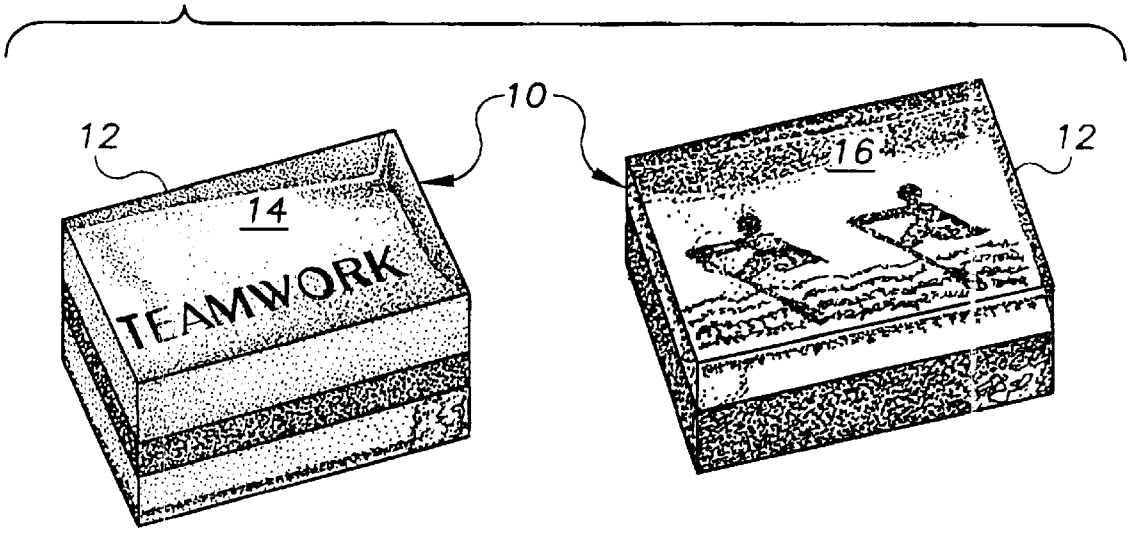
FIG. 1 is a perspective view of the inventive device.

Referring now to FIG. 1, top and bottom perspective views of the inventive device are provided. Particularly, sifter device 10 is comprised of a transparent body 12. A view into a first compartment 14 shows the word "TEAMWORK". In its inverted position, the device 10 provides a view into a second compartment 16, showing a design of rowers demonstrating teamwork.

Figure 2:
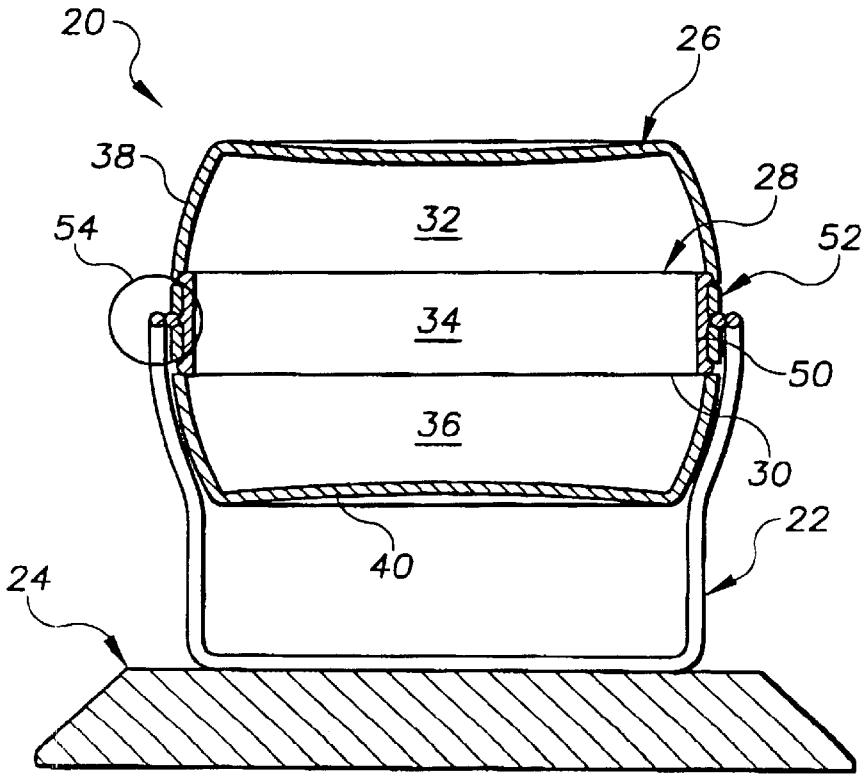
FIG. 2 is a side elevation view in cross section of an alternative embodiment of the device.

Referring now to FIG. 2, an alternative embodiment of the invention is depicted wherein the sifter device 20 is rotatably positioned on a stand 22, secured to a base 24. The sifter device 20 consists of a transparent body 26 divided via partition plates 28 and 30 into a first compartment 32, central compartment 34, and second compartment 36. The transparent body is composed of a first cup-shaped body 38 and a second cup shaped body 40 joined via an intermediate member 50. Intermediate member 50 also retains partition plates 28 and 30 against cup-shaped bodies 38 and 40, respectively. Preferably, the cup-shaped bodies 30 and 40 are molded from polycarbonate, acrylonitrile-butadiene-styrene copolymer, high impact polysytrene or acrylic.

A cosmetically attractive band 52 encircles the intermediate member 50 to shield the central compartment 34 from view through the sides of the device 20. The stand 22 is attached to the device 20 through rotatable element 54 which allows inversion of the device and preferably releasibly locks into position. While not shown, a particulate fill material will be present to substantially fill compartment 36 (in the depicted orientation). However, the fill material may extend slightly above the level of partition plate 30 in certain embodiments. As a general rule, a body 26 having a volume of approximately 30 cubic inches will contain between 150 and 300 grams, preferably between 175 and 200 grams, of a fill material having a 100–250 mesh size. In addition, the partition plates will be properly spaced apart from one another to achieve proper flow from the top to the bottom chamber. In a device of approximately 30 cubic inches, a spacing of about 0.5 inches between partition plates is satisfactory. Of course, this distance may vary depending upon the size of the device.

Figure 3:
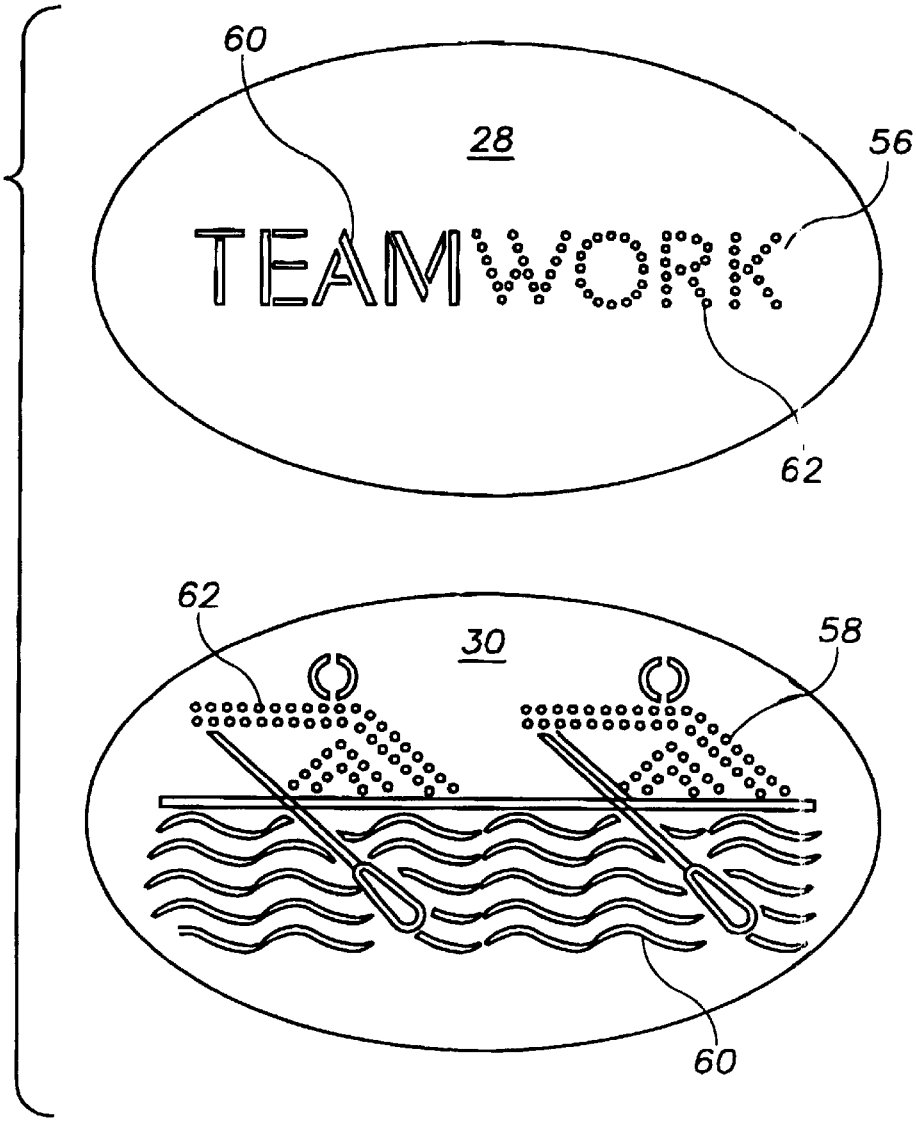
FIG. 3 is a top plan view of the partition plates of the invention.

Referring now to FIG. 3, the partition plates of FIG. 2 are shown in detail. Particularly, the partition plate 28 depicts the text "TEAMWORK" 56 and the partition plate 30 depicts an image of a team of rowers 58 demonstrating teamwork. As shown, the text and image are comprised of a combination of holes 60 and lines 62. It is preferred that the invention include a line weight (width) or a hole size in the range from 0.01 to 0.10 inches. Commensurate with this is the use of an appropriately sized fill material which is preferably between 30 and 1000 microns in nominal diameter. This size can also be expressed as mesh size, such as in the preferred range of 125–300 mesh (50–125 microns). It is also preferred that the particulate material be treated with an anti-static or lubricating agent and is preferably colored, depending on the application. For example, colors of a sporting team or corporate identity would be suitable. In addition, it may be desirable to add an anti-static agent to the resin forming the housing. A particularly preferred particulate material is Powder Industry Inc., BALLOTINI® impact beads, designation AE, treated with MoldWiz Lubricant (AXEL Plastics Research Laboratories, Inc., Woodside, N.Y.). It should also be noted that the housing can be constructed of a shape such as round, oval, square, rectangular, etc. A particularly preferred form of the invention is shaping the device in the form of sporting equipment such as a football, hockey puck, baseball or bat, and using a sporting team's name and logo on the partition plates in association with a particulate fill material colored to match the team's colors.

Figure 4:
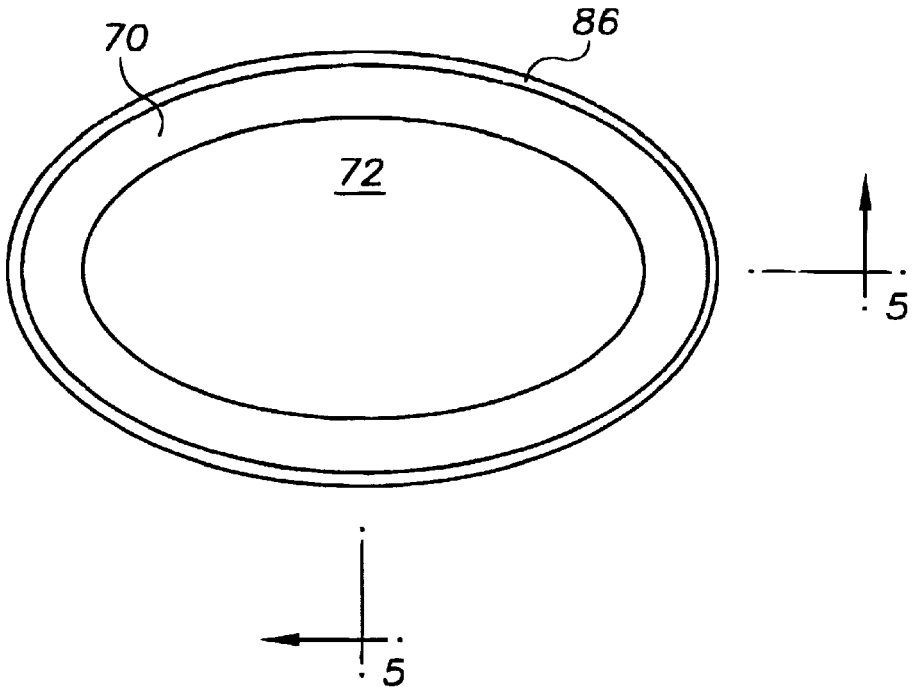
FIG. 4 is a top view, of an alternative embodiment of the device.
Figure 5:
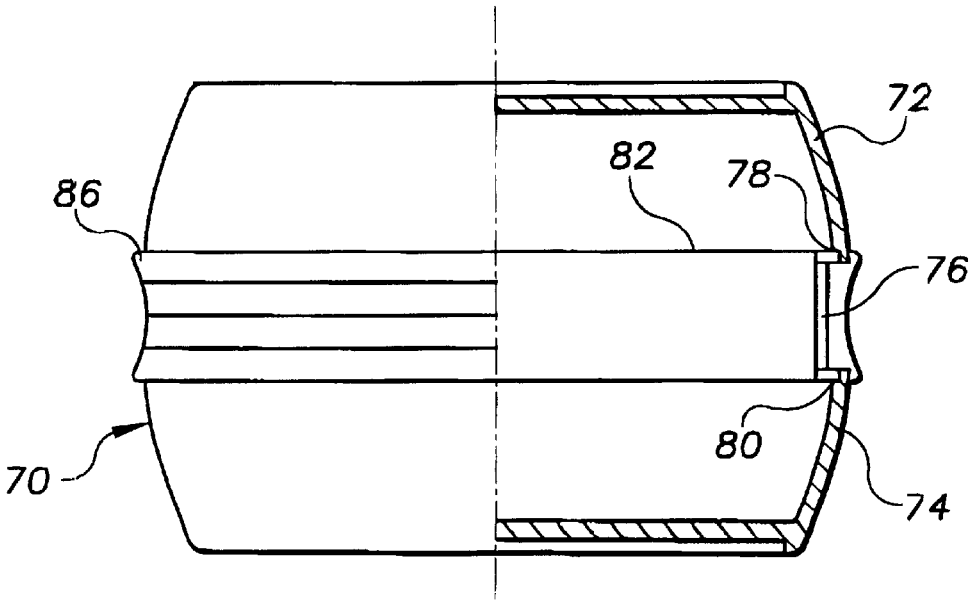
FIG. 5 is a side elevation view, partially in cross section of the device FIG. 4.

Referring now to FIGS. 4 and 5, an alternative embodiment of the invention is depicted. Specifically, a generally oval shaped chamber 70 is provided. As in the prior embodiments, the chamber 70 is comprised of a first transparent body 72, a second transparent body 74, and a central body 76 joining transparent body 72 to transparent body 74. Again, central body 76 acts in conjunction with notches 78 and 80 in transparent body 72 and transparent body 74, respectively, to secure partition members 82 and 84. The central body 76 is surrounded by a band 86 comprised of elastomeric material such as any thermoplastic elastomer, providing an appealing feel to the device, having a Shore A hardness in the range of 30–50.

Figure 6:
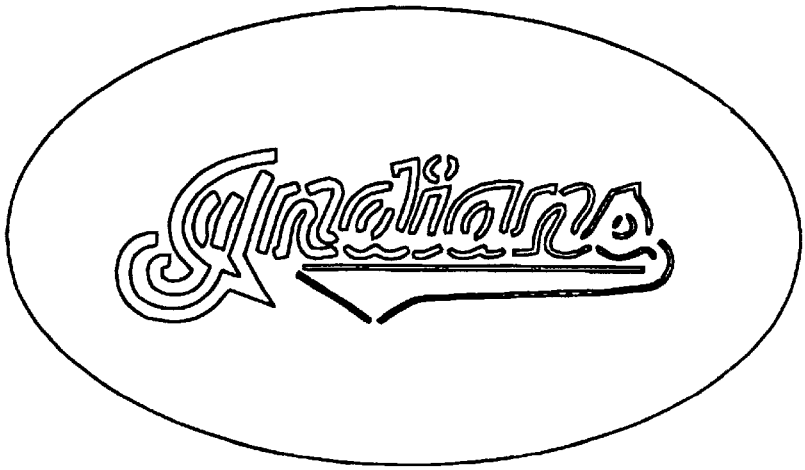
FIG. 6 is a depiction of a partition plate including varied line weights.

Turning now to FIG. 6, a particularly preferred form of the invention is depicted in the form of the text, which is also applicable to any designs formed in the partitions. Moreover, the depicted text is constructed of line weight which progressively diminishes in width from left to right. In this manner, upon inversion of the device to position the text of FIG. 6 at the top of the device, particulate flow will occur faster at the left hand side and the word appears to a viewer in a left to right direction much in the way that a scripted word would be penned. While only this embodiment is presented, it is envisioned that the device can use this technique to create images and text appearing from left to right, top to bottom, and inside to outside, etc.

Figure 7:
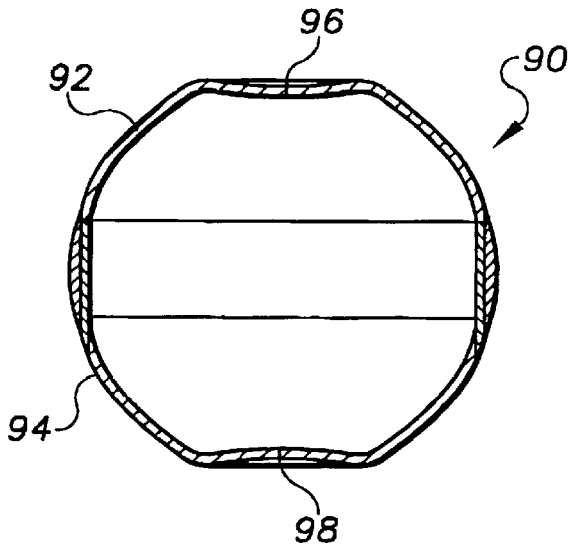
FIG. 7 is a side elevation view, in cross section, of an alternative embodiment of the invention.

Referring now to FIG. 7, device 90 is depicted wherein the top 92 and bottom 94 chambers include elastomeric plugs 96 and 98, respectively, providing a suitable surface upon which the device can rest. This embodiment is particularly attractive because of the generally spherical shape of the device 90 which is appealing to handle.

Figure 8:
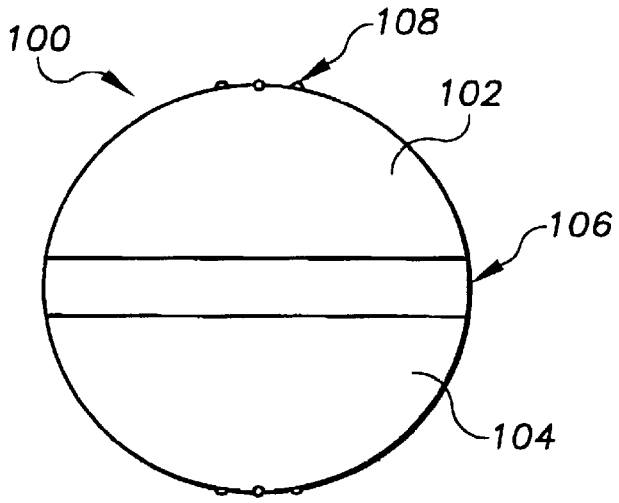
FIG. 8 is a side elevation view of an alternative embodiment of the invention.
Figure 9:
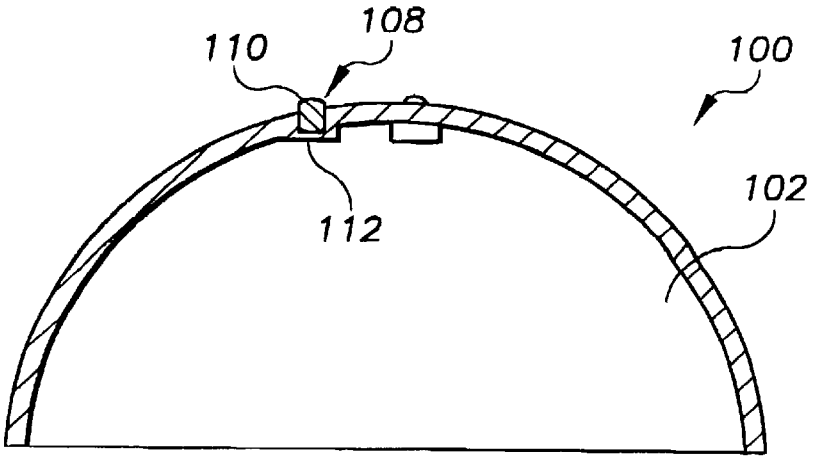
FIG. 9 is an exploded cross-sectional view of the stand component of FIG. 8.

Referring now to FIGS. 8 and 9, an alternative embodiment of the device 100 is depicted wherein transparent chambers 102 and 104 are semi-spheres mated with a central member 106 to provide a generally spherical device equipped with elastomeric nipples 108 which provide a stand upon which the device can rest. Referring to FIG. 9, the nipples 108 are thermoplastic elastomeric members 110 disposed within a molded recess 112. This aspect of the invention is particularly desirable because the sight lines to the images in the partition plates (not shown) are clean. Alternatively, and preferably from a manufacturing standpoint, the nipples can be molded components of the housing forming the chambers.

As stated earlier, an important aspect of the present invention is the utilization of an appropriate combination of glass bead and line weight or hole diameter. More specifically, to achieve an appropriate visual impression, it is desirable to have the fill substantially pass through the partitions once the device is inverted and placed to rest within less than 30 seconds. Given this statement, it is clear that a certain portion of the fill material will remain on the surface of the partition adjacent the openings. In fact, it is this remaining fill in conjunction with the openings which helps provide the visual image or text via contrast in colors.

Thus, it is apparent there has been provided, in accordance with the invention, a novelty device that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to erase all such alternatives, modifications and variations as fall within the spirit and broad scope of the appended claims.

What is claimed is:

1. A novelty device comprised of a transparent body defining a chamber, a first horizontal partition having a plurality of openings positioned to depict text or design traversing said chamber, a second horizontal partition having a plurality of openings positioned to depict text or design transversing said chamber, said first and second partitions in a generally spaced coplanar relationship such that said chamber is divided into a top area, a central area between said partitions, and a bottom area, a particulate fill material contained within said chamber, said openings having a diameter or line weight of less than about 0.10 inches and adapted for flowing some of said particulate material from the top area completely therethrough to depict the text or design defined by the openings, the text or design being further defined by the remaining particulate resting on said first or second horizontal partition adjacent the top area, said particulate fill material having a nominal diameter between about 30 and 1000 microns.

2. The device of claim 1 wherein said particulate material has a nominal diameter of between about 50 and 125 microns.

3. The device of claim 1 wherein said particulate material comprises glass beads.

4. The device of claim 1 wherein said particulate material is treated with a lubricant or anti-static agent.

5. The device of claim 1 wherein flow of said particulate material through a top one of said partition is completed in between 5 and 30 seconds after inversion of said device.

6. The device of claim 1 wherein said particulate material is colored.

7. The device of claim 1 wherein one of said partitions includes an image and the other partition includes text.

8. The device of claim 7 wherein said image and said text are representations of one another.

9. The device of claim 1 wherein said chamber includes a band surrounding said central area.

10. The device of claim 1 wherein said chamber is square, rectangular, round or oval.

11. The device of claim 1 wherein said chamber is supported on a stand.

12. The device of claim 9 wherein said band is comprised of an elastomeric material.

13. The device of claim 1 wherein said openings decrease in diameter or line weight from one side of the partition to an opposed side.

14. The device of claim 3 wherein at least 70% of said particulate fill material is generally round in shape.

15. A novelty device comprised of a generally spherical transparent body defining a chamber, first and second horizontal partitions having a plurality of openings depicting text or design traversing said chamber, said first and second partitions in a generally spaced co-planar relationship, such that said chamber is divided into a top area, a central area between said partitions, and a bottom area, a particulate fill material disposed within said chamber, said openings adapted to allow a portion of the particulate fill material to flow completely therethrough to depict the text or design, while another portion of the particulate fill remains at rest on the upper horizontal partition adjacent the top area to further define the text or design depicted by the plurality of openings through which the particulate flows, said transparent body including a means for standing said body on a flat surface.

16. The device of claim 15 wherein said body is comprised of two semi-spherical halves and an intermediate ring member.

17. A novelty device comprised of a generally spherical transparent body defining a chamber, said body being composed of two semi-spherical halves and an intermediate ring member, first and second horizontal partitions having a plurality of openings depicting text or design traversing said chamber, said first and second partitions in a generally spaced co-planar relationship such that said chamber is divided into a top area, a central area between said partitions, and a bottom area, a particulate fill material disposed within said chamber and adapted to flow through the openings from a top area to the central or bottom areas, said transparent body including a means for standing said body on a flat surface, wherein said ring member is comprised of an elastomeric material or is surrounded by a band of elastomeric material.

18. The device of claim 15 wherein the means for standing said body on a flat surface comprises two groups of outwardly extending nipples on opposed sides of said transparent body, said nipples positioned to form a stand.

19. The device of claim 1 wherein the openings have progressively diminishing diameters so that the fill material flows through the openings at diminishing rates.

* * * * *